US011149475B2

(12) United States Patent
Kito et al.

(10) Patent No.: US 11,149,475 B2
(45) Date of Patent: Oct. 19, 2021

(54) DOOR DEVICE FOR VEHICLE

(71) Applicant: AISIN SEIKI KABUSHIKI KAISHA, Kariya (JP)

(72) Inventors: Kosuke Kito, Chiryu (JP); Eiji Itami, Chiryu (JP); Ryu Miyashiro, Aichi-gun (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 253 days.

(21) Appl. No.: 16/429,108

(22) Filed: Jun. 3, 2019

(65) Prior Publication Data

US 2020/0032563 A1 Jan. 30, 2020

(30) Foreign Application Priority Data

Jul. 24, 2018 (JP) ..... JP2018-138388

(51) Int. Cl.
*E05B 81/76* (2014.01)
*E05B 81/20* (2014.01)
*E05C 17/00* (2006.01)

(52) U.S. Cl.
CPC ..... *E05C 17/003* (2013.01); *E05B 81/20* (2013.01); *E05B 81/76* (2013.01)

(58) Field of Classification Search
CPC .... E05C 17/003; E05C 17/006; E05C 17/203; E05B 81/20; E05B 81/76; E05B 81/14; E05B 81/13; E05F 15/60
See application file for complete search history.

(56) References Cited

U.S. PATENT DOCUMENTS 7,438,346 B1 * 10/2008 Breed ..... E05C 17/203 296/146.12
2001/0010429 A1 * 8/2001 Jyawook ..... E05B 77/24 292/347
2002/0066158 A1 * 6/2002 Breed ..... E05C 17/203 16/64
2003/0038485 A1 * 2/2003 Schwaiger ..... E05B 81/14 292/201
2004/0055110 A1 * 3/2004 Breed ..... E05C 17/203 16/82
2006/0048451 A1 * 3/2006 Fukumura ..... E05B 81/70 49/360
2008/0296927 A1 * 12/2008 Gisler ..... E05F 15/43 296/146.4

(Continued)

FOREIGN PATENT DOCUMENTS

JP 2012-087547 5/2012
JP 2016-217031 12/2016

*Primary Examiner* — Justin B Rephann
(74) *Attorney, Agent, or Firm* — Oblon, McClelland, Maier & Neustadt, L.L.P.

(57) ABSTRACT

A door device for a vehicle includes a latch drive device configured to unlatch a swing door by driving a latch mechanism, a door hold-open device configured to hold the swing door at an opened angle by applying a braking force to the swing door, a door open switch issuing an operation request of the latch drive device to open the swing door; a door stop switch issuing an operation request of the door hold-open device, and a grip portion including the door open switch and the door stop switch to issue the operation requests of the door open switch and the door stop switch in a state where an occupant of the vehicle holds the grip portion.

5 Claims, 7 Drawing Sheets

(56) References Cited

U.S. PATENT DOCUMENTS

| | | | | |
|---|---|---|---|---|
| 2008/0309120 | A1* | 12/2008 | Kohlstrand | E05C 17/003 296/146.11 |
| 2009/0051192 | A1* | 2/2009 | Ewing | E05F 15/622 296/146.2 |
| 2013/0074412 | A1* | 3/2013 | Wellborn | E05C 17/203 49/381 |
| 2014/0150581 | A1* | 6/2014 | Scheuring | E05F 15/622 74/89.38 |
| 2015/0059250 | A1* | 3/2015 | Miu | E05F 15/614 49/349 |
| 2016/0010379 | A1* | 1/2016 | Sauerwein | E05F 15/53 701/49 |
| 2016/0032624 | A1* | 2/2016 | Bendel | E05B 81/64 49/31 |
| 2017/0030132 | A1* | 2/2017 | Elie | E05F 15/611 |
| 2017/0328097 | A1* | 11/2017 | Gruber | E05C 17/006 |
| 2018/0179788 | A1* | 6/2018 | Oxley | E05C 17/203 |
| 2019/0309564 | A1* | 10/2019 | Mitchell | E05B 81/70 |
| 2020/0080348 | A1* | 3/2020 | Cappelli | E05B 81/64 |

* cited by examiner

DOOR DEVICE FOR VEHICLE

CROSS REFERENCE TO RELATED APPLICATIONS

This application is based on and claims priority under 35 U.S.C. § 119 to Japanese Patent Application 2018-138388, filed on Jul. 24, 2018, the entire content of which is incorporated herein by reference.

TECHNICAL FIELD

This disclosure generally relates to a door device for a vehicle.

BACKGROUND DISCUSSION

A known door device holds a swing door of a vehicle at a free opened angle. For example, according to the door device disclosed in JP2012-87547A (hereinafter referred to as Patent reference 1), in a case where a door handle switch indicating an intention of an occupant to open the door is turned on, the opening and closing operation of the swing door is allowed, and in a case where the door handle switch is turned off, the opened angle of the swing door is held. Employing a holding function of the door at the opened angle, the door device may not open or close a swing door by outer force, for example, when an occupant use the swing door as a handrail or a grab bar when entering or leaving the vehicle, strong wind, or an inclination of a road.

However, an efficient operability is an important challenge or task for the door device for the vehicle in addition to a basic performance. The configuration of the conventional door device described above cannot always satisfy a requirement level of the vehicle which evolves day to day.

A need thus exists for a door device for a vehicle which is not susceptible to the drawback mentioned above.

SUMMARY

According to an aspect of this disclosure, a door device for a vehicle includes a swing door of the vehicle, a latch mechanism provided at the swing door, a latch drive device configured to unlatch the swing door by driving the latch mechanism, a door hold-open device configured to hold the swing door at an opened angle by applying a braking force to the swing door, a door open switch issuing an operation request of the latch drive device to open the swing door, a door stop switch issuing an operation request of the door hold-open device, and a grip portion employed to open and close the swing door the grip portion including the door open switch and the door stop switch to issue the operation requests of the door open switch and the door stop switch in a state where an occupant of the vehicle holds the grip portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
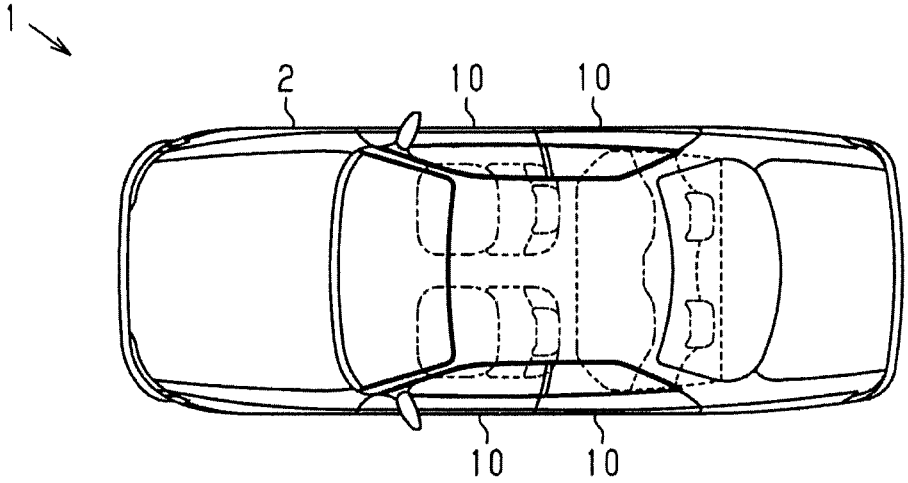
FIG. 1 is a plan view of a vehicle including a swing door.

Hereinafter, an embodiment of a door device for a vehicle will be explained with reference to the drawings. As illustrated in FIGS. 1, 2A, 2B and 2C, a vehicle 1 of the embodiment includes four swing doors 10 opening and closing door opening portions 3 arranged at side surfaces of a vehicle body 2. That is, each of the swing doors 10 rotates about hinges 11 arranged at a front end portion 10*f* of the swing door 10. The vehicle 1 of the embodiment is configured such that each of the swing doors 10 opens and closes at each side of a passenger seat provided in a compartment of the vehicle 1.

As illustrated in FIGS. 2A, 2B, 2C and 3, the swing door 10 of the embodiment includes a latch mechanism 20 and a latch drive device 21. The latch mechanism 20 holds the swing door 10 at a fully-closed position by being engaged with a striker provided at the vehicle body 2. The latch drive device 21 drives the latch mechanism 20.

In particular, the latch drive device 21 of the embodiment serves as a door closer shifting the swing door 10 from a half-latched state to a fully-latched state by driving the latch mechanism 20 when the swing door 10 operates to be fully closed. The latch drive device 21 includes an unlatching function shifting the swing door 10 from the fully-latched state to the unlatched state by driving the latch mechanism 20 when the swing door 10 opens from the fully-closed position. The latch drive device 21 of the embodiment includes a pop-up function ejecting (or disengaging) the striker engaged with the latch mechanism 20 by an unlatching operation.

The swing door 10 of the embodiment includes a door hold-open device 31 which is integrally provided with a door check mechanism 30. The swing door 10 of the embodiment is held at a desirable opened angle θ by the door hold-open device 31 which applies braking force F to the swing door 10.

The swing door 10 of the embodiment includes an operation switch 40 for issuing operation requests of the door hold-open device 31 and the latch drive device 21. The vehicle 1 of the embodiment is provided with a door device 41 that operates the operation switch 40 in a case where the swing door 10 is manually opened to unlatch the swing door 10 by the latch mechanism 20 and to hold the swing door 10 at the desirable opened angle θ.

Figure 2B:
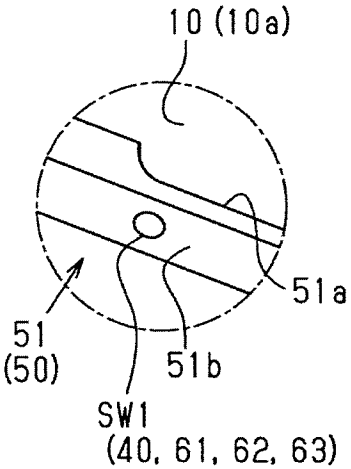
FIG. 2B is an enlarged view of a grip portion provided at an inner panel of the swing door.
Figure 2C:
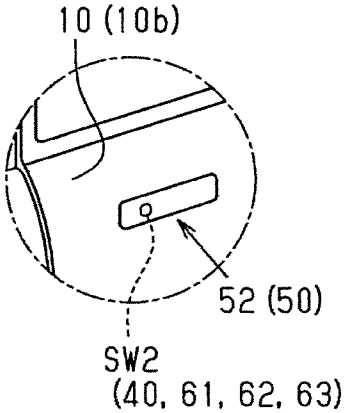
FIG. 2C is an enlarged view of a grip portion (outside door handle) provided at an outer panel of the swing door.
Figure 2A:
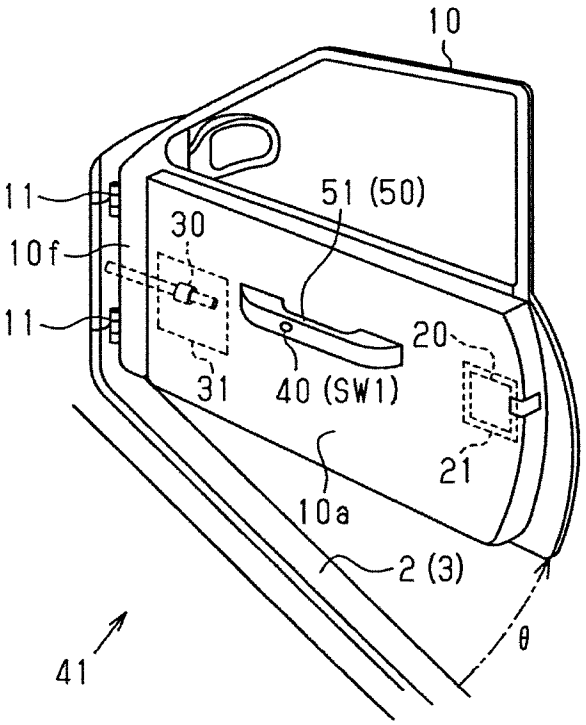
FIG. 2A is a perspective view of the swing door which is in an open state.

In particular, as illustrated in FIGS. 2A and 2B, the swing door 10 of the embodiment includes a grip portion 51 (50) provided at an inner panel 10*a* and an inner switch SW1 arranged at the grip portion 51 which is provided inside the vehicle. As shown in FIG. 2C, the swing door 10 includes an outer switch SW2 provided at the outside door handle 52. The door device 41 of the embodiment is configured such that the inner switch SW1 and the outer switch SW2 are employed as the operation switch 40.

Specifically, as illustrated in FIG. 2B, the swing door 10 of the embodiment is configured such that the grip portion 51 arranged inside of the vehicle 1 includes a recessed portion 51*a* opening upwardly. That is, the grip portion 51 is gripped in a state where fingers (for example, four fingers) other than a thumb of an occupant are entered into the recessed portion 51*a* in a case where the occupant of the vehicle 1 opens and closes the swing door 10. The inner switch SW1 of the embodiment is arranged at an outer portion 51*b* of the grip portion 51 arranged outside the recessed portion 51*a*. Accordingly, the door device 41 is configured such that the occupant may operate the inner switch SW1 by using his/her thumb arranged outside the recessed portion 51*a* while gripping the grip portion 51.

As illustrated in FIG. 2C, according to the vehicle 1 of the embodiment, the outside handle 52 including the grip portion arranged outside the vehicle 1 includes a configuration as a flush handle protruding from the outer panel 10*b* in a case where the regular occupant having an operation authority of the vehicle 1 reaches the swing door 10. That is, the outside handle 52 of the embodiment protrudes from the outer panel 10*b* so that the occupant grips the outside door handle 52 such that the fingers of the occupant are entered into a clearance formed between the outside door handle 52 and the outer panel 10*b*. The outer switch SW2 of the embodiment is arranged at a position where the occupant operates the outer switch SW2 by the fingers entered into the clearance between outside door handle 52 and the outer panel 10*b*.

Figure 3:
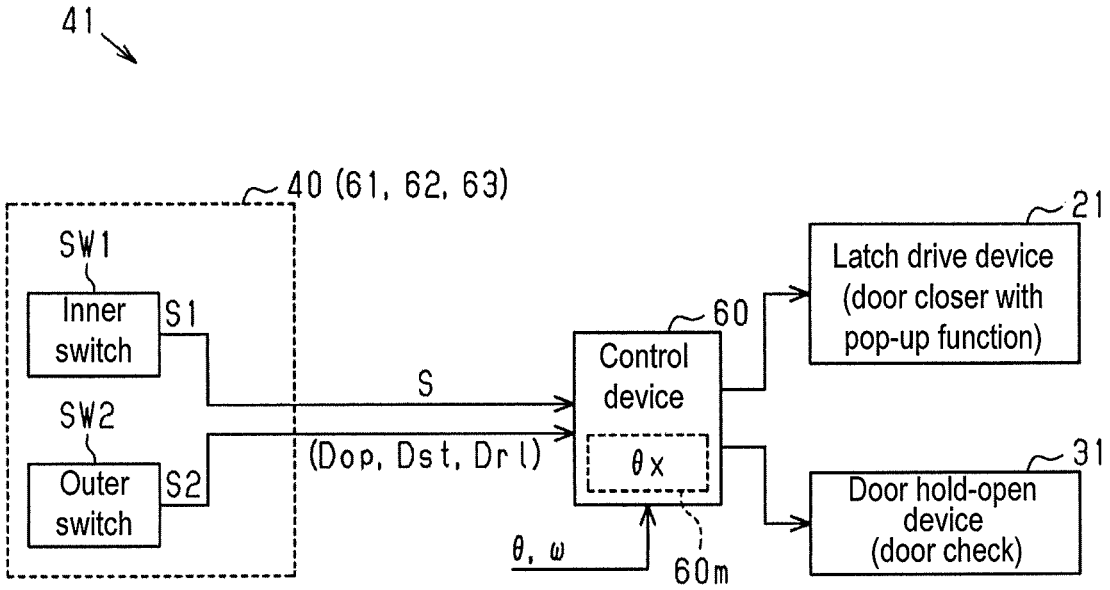
FIG. 3 is a configuration diagram schematically illustrating a door device for the vehicle.

In particular, as illustrated in FIG. 3, the door device 41 of the embodiment includes a control device 60 controlling operations of the latch drive device 21 and the door hold-open device 31. The control device 60 detects operation input relative to the operation switch 40 (SW1, SW2) in response to output signals S1, S2 outputted by the inner switch SW1 and the outer switch SW2, respectively. The control device 60 detects an operation request (a door open request Dop) of the latch drive device 21 and operation requests (a door stop request Dst, a release request Drl) of the door hold-open device 31 in response to the operation input relative to the operation switch 40. The control device 60 of the embodiment controls the latch drive device 21 and the door hold-open device 31 in response to the operation request indicated by the operation input relative to the operation switch 40 to unlatch the swing door 10 by the latch mechanism 20, to hold the swing door 10 at the opened angle θ, and to release the swing door 10 from the hold of the swing door 10 which is at the opened angle θ.

That is, according to the door device 41 of the embodiment, the operation switch 40 (SW1, SW2) arranged at the grip portion 50 (51, 52) of the swing door 10 serves as a door open switch 61 issuing the operation request (the door open request Dop) of the latch drive device 21 to open the swing door 10. The operation switch 40 serves as a door stop switch 62 issuing the operation request (the door stop request Dst) of the latch drive device 21 to hold the swing door 10 at the opened angle θ. According to the door device 41 of the embodiment, the occupant of the vehicle 1 can operate a series of door operation when entering and leaving the vehicle 1 in a state of gripping the grip portion 50 provided at the swing door 10, the series of door operation including unlatching of the latch mechanism 20 of the swing door 10 (door opening operation) and holding of the swing door 10 at the desirable opened angle θ (door stopping operation).

The operation switch 40 also serves as a releasing switch 63 that issues the operation input (the release request Drl) for releasing the hold of the swing door 10 which is at the opened angle θ by the latch drive device 21. The door device 41 of the embodiment adjusts the opened angle θ of the swing door 10 by releasing the hold of the swing door 10 which is at the opened angle θ while the occupant holds the grip portion 50 of the swing door 10.

The operation controls of the latch drive device 21 and the door hold-open device 31 will hereunder be explained. In particular, the operation controls of the latch drive device 21 and of the door hold-open device 31 operated by the control device 60 of the embodiment will hereunder be explained.

According to the door device 41 of the embodiment, the inner switch SW1 and the outer switch SW2 each serving as the operation switch 40 and being arranged at the grip portion 50 (51, 52) of the swing door 10 correspond to pressing button switches turning on and off by pressing operations.

The control device 60 of the embodiment detects the opened angle θ of the swing door 10 (see FIG. 3). The control device 60 detects opening operation state of the swing door 10 in response to the opened angle θ of the swing door 10 detected by the control device 60, and operation states of the latch drive device 21 and the door hold-open device 31. The control device 60 of the embodiment detects the operation request (Dop) of the latch drive device 21 and the operation request (Dst, Drl) of the door hold-open device 31 in response to the opening operation state of the swing door 10 when the operation switch 40 is operated.

Figure 4:
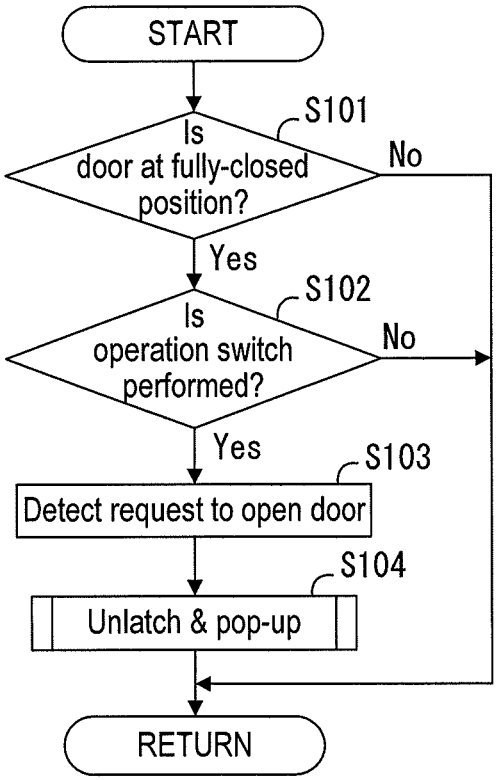
FIG. 4 is a flowchart illustrating an operation procedure of a door opening control.

In particular, as shown in a flowchart in FIG. 4, in a state where the swing door 10 is latched in the fully-closed position by the latch mechanism 20 (Step S101: YES), and in a case of determining that the operation switch 40 is operated (Step S102:YES), the control device 60 of the embodiment detects the door open request Dop (Step S103) requested by the occupant. That is, the control device 60 of the embodiment shall consider that the operation request of the latch drive device 21 is inputted to the operation switch 40 which serves as the door open switch 61. The control device 60 controls the latch drive device 21 based on the door open request Dop, and shifts the swing door 10 to a manually openable state (Step S104) by unlatching (or popping-up) the swing door 10 by the latch mechanism 20.

Figure 5:
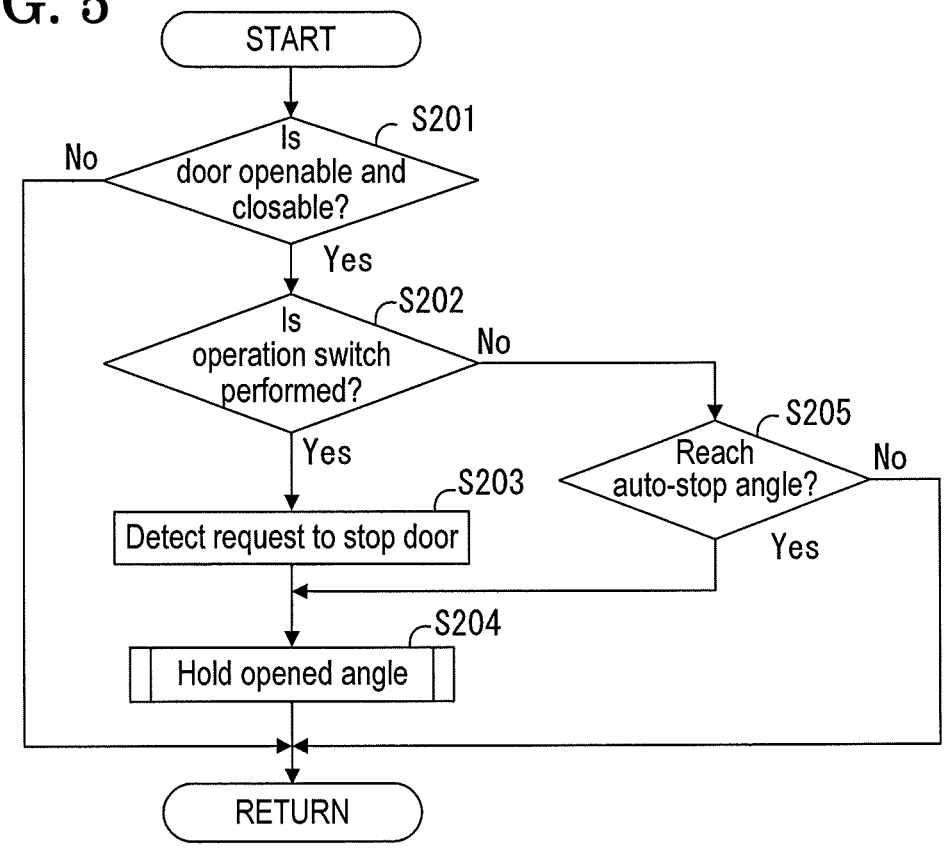
FIG. 5 is a flowchart illustrating an operation procedure of a holding control of an opened angle.

As shown in a flowchart in FIG. 5, in a state where the swing door 10 is openable and closable by the unlatching operation (Step S201: YES), and in a case of determining that the operation switch 40 is operated (Step S202: YES), the control device 60 of the embodiment detects the door strop request Dst (Step S203) requested by the occupant. That is, the control device 60 of the embodiment determines that the operation request is inputted to the operation switch 40 serving as the door stop switch 62, the operation request to hold the swing door 10 at the opened angle θ. Then, the control device 60 controls the door hold-open device 31 in response to the door stop request Dst to hold the swing door 10 at the opened angle θ (Step S204).

In a case of determining that the swing door 10 is openable and closable (Step S201: YES) and that the operation switch 40 is not operated (Step S202: NO), the control device 60 of the embodiment determines whether the opened angle θ of the swing door 10 reaches an auto stop angle θx (see FIG. 3) which is maintained or memorized previously at a memory region 60*m* (Step S205). In a case of determining that the opened angle θ of the swing door 10 reaches the auto stop angle θx (Step S205: YES), the control device 60 operates Step S204 irrespective of whether the operation is inputted to the operation switch 40 to hold the swing door 10 at the opened angle θ.

Figure 6:
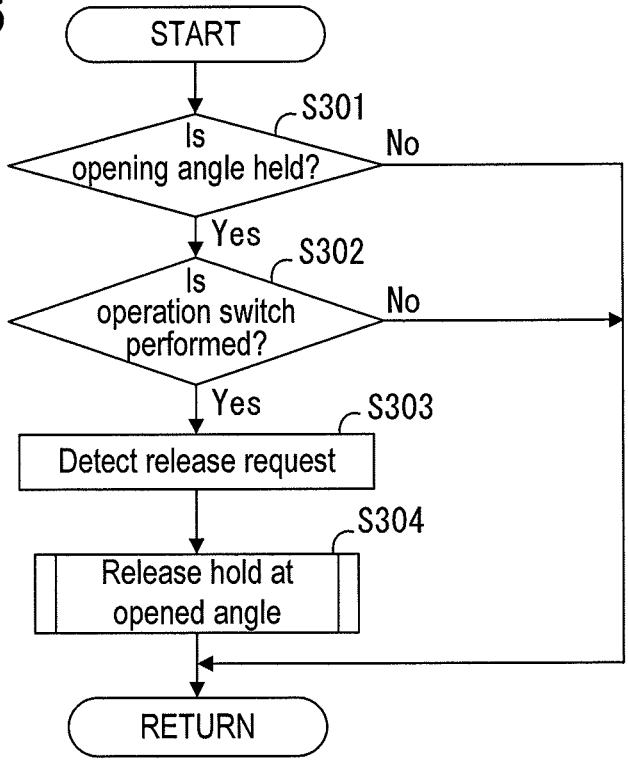
FIG. 6 is a flowchart illustrating an operation procedure of an release control of the opened angle.

As illustrated in a flowchart in FIG. 6, in a state where the opened angle θ of the swing door 10 is held (Step S301: YES), and in a case of determining that the operation switch 40 is operated (Step S302: YES), the control device 60 of the embodiment detects the release request Drl required by the occupant (Step S303). That is, the control device 60 of the embodiment determines that the operation request for releasing the hold of the swing door 10 which is at the opened angle θ by the door hold-open device 31 is inputted to the operation switch 40 serving as the releasing switch 63. The control device 60 controls the door hold-open device 31 in response to the release request Drl to release the hold of the swing door 10 which is at the opened angle θ, and shifts the swing door 10 to an openable and closable state (Step S304).

That is, for example, when the occupant gets off the vehicle 1, the occupant opens the swing door 10 by operating the operation switch 40 (the inner switch SW1) provided at the grip portion 51 while holding the grip portion 51 arranged inside the vehicle. The door device 41 of the embodiment thus unlatches the swing door 10 by the latch mechanism 20 so that the occupant holding the grip portion 51 opens the swing door 10 manually.

Furthermore, the occupant opening the swing door 10 operates the operation switch 40 again provided at the grip portion 51 when the swing door 10 is in an open state at the desirable opened angle θ. Then, the door device 41 of the embodiment is configured such that the occupant of the vehicle 1 may leave the vehicle 1 while using the swing door 10 as a handrail or a grab bar, or while holding the swing door 10 so that the swing door 10 does not to come in contact with an obstacle, for example, a vehicle parked next to the vehicle, because the swing door 10 is held at the desirable opened angle θ.

The door device 41 of the embodiment opens and closes the swing door 10 again by re-operation of the operation switch 40 provided at the grip portion 51 even after the swing door 10 is held at the opened angle θ. Accordingly, the occupant holding the grip portion 51 adjusts the opened angle θ of the swing door 10 speedily.

The control device 60 of the embodiment sets a predetermined operation confirmation time (t1) when determining an operation input relative to the operation switch 40. Accordingly, the misjudgment may be inhibited from being generated.

Figure 7:
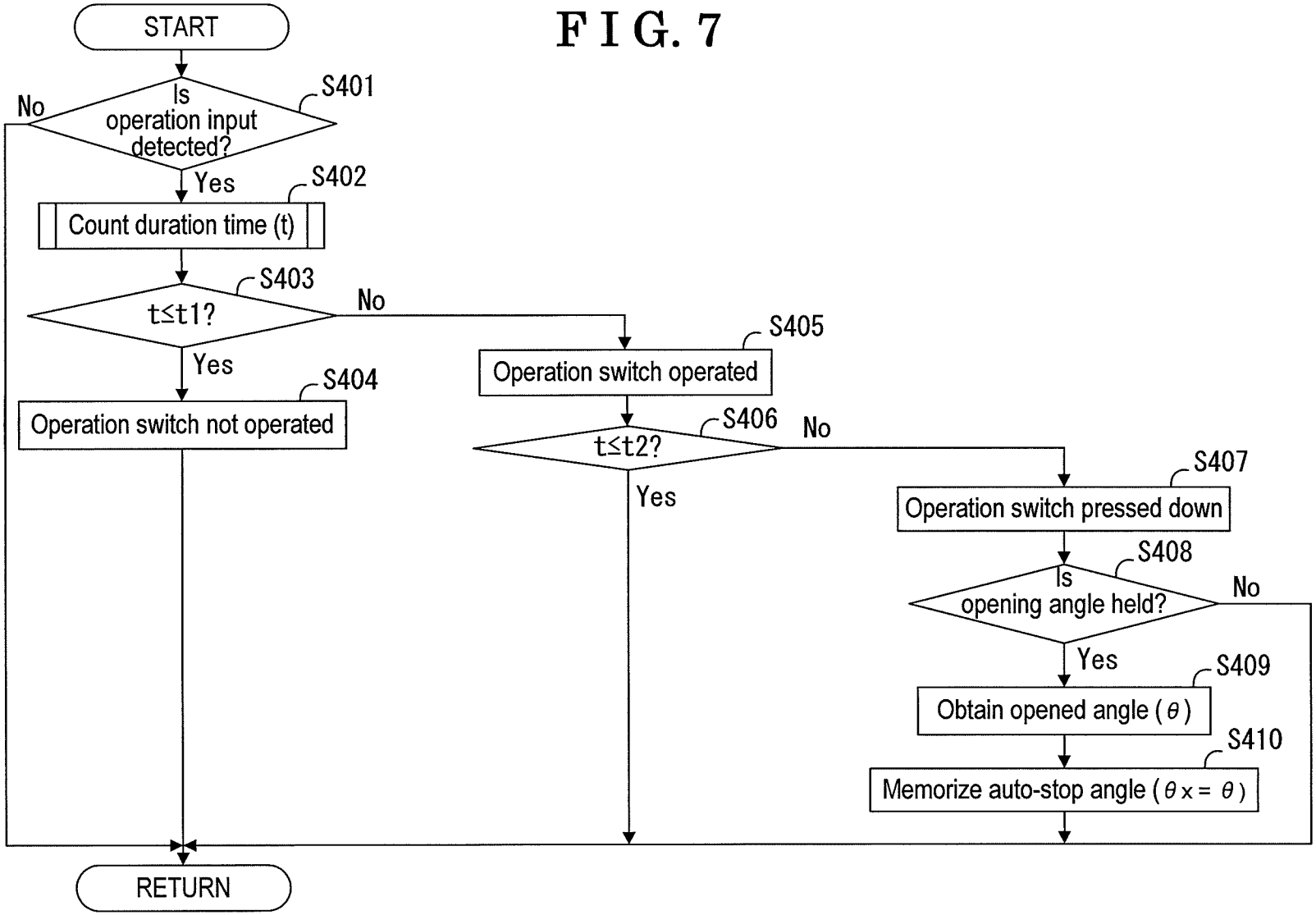
FIG. 7 is a flowchart illustrating an operation procedure of a confirmation determination of an operation input and a memorization of an auto-stop angle.

As illustrated in a flowchart in FIG. 7, in a case where the operation input is detected in response to the output signals S (S1, S2) of the operation switch 40 (SW1, SW2) (Step S401: YES), the control device 60 of the embodiment counts a duration time t (Step S402). By comparing the duration time t with the predetermined operation confirmation time t1, the control device 60 determines whether the operation switch 40 is operated by the occupant who intentionally operates it.

In particular, in a case where the duration time t of the operation input detection based on the output signal S is equal to or shorter than the predetermined operation confirmation time t1 (t≤t1, Step S403: YES), the control device 60 of the embodiment determines that the operation switch 40 is not operated (Step S404). Then, in a case where the duration time t is longer than the predetermined operation confirmation time t1 (t>t1, Step S403: NO), the control device 60 determines that the operation switch 40 is operated (Step S405).

That is, the door device 41 of the embodiment is configured to be inhibited from misjudging by an unintentional contact relative to the operation switch 40 during the opening and closing operation of the swing door 10, or during the hold of the swing door 10 which is at the opened angle θ by the setting of the predetermined operation confirmation time t1. Accordingly, the enhanced reliability may be secured by the inhibition of a phenomenon in which the swing door 10 is suddenly stopped or in which the swing door 10 is released from being held at opened angle θ while the occupant enters and leaves the vehicle in a state of using the swing door 10 as the handrail or the grab bar.

In a case where the duration time t for the operation input detection relative to the operation switch 40 is greater than a predetermined memory requirement time t2 which is longer than the predetermined operation confirmation time t1 (t>t2, Step S406: NO), the control device 60 of the embodiment determines that the operation switch 40 is pressed down, or is pressed down for a certain period of time (Step S407). Next, in this case, the control device 60 of the embodiment determines whether the swing door 10 is held at the opened angle θ (Step S408). In a case where the swing door 10 is held at the opened angle θ (Step S408: YES), the control device 60 obtains the opened angle θ (Step S409) and memorizes the value to the memory region 60*m* as an auto-stop angle θx (hereinafter referred to as an auto-stop angle θx) (see FIG. 5, Step S205) (θx=θ, Step S410).

That is, according to the door device 41 of the embodiment, the occupant may freely specify the auto-stop angle θx of the swing door 10 by pressing down the operation switch 40 while holding the swing door 10 at the desirable opened angle θ. The door device 41 of the embodiment resets the value of the auto-stop angle θx (see FIG. 3) memorized in the memory region 60*m* of the control device 60 by a predetermined operating procedure. In this state, the door device 41 of the embodiment performs the setting operation again by pressing down the operation switch 40 for a certain period of time to reset or reestablish the value of the auto-stop angle θ memorized in (the memory region 60*m* of) the control device 60.

Figure 8:
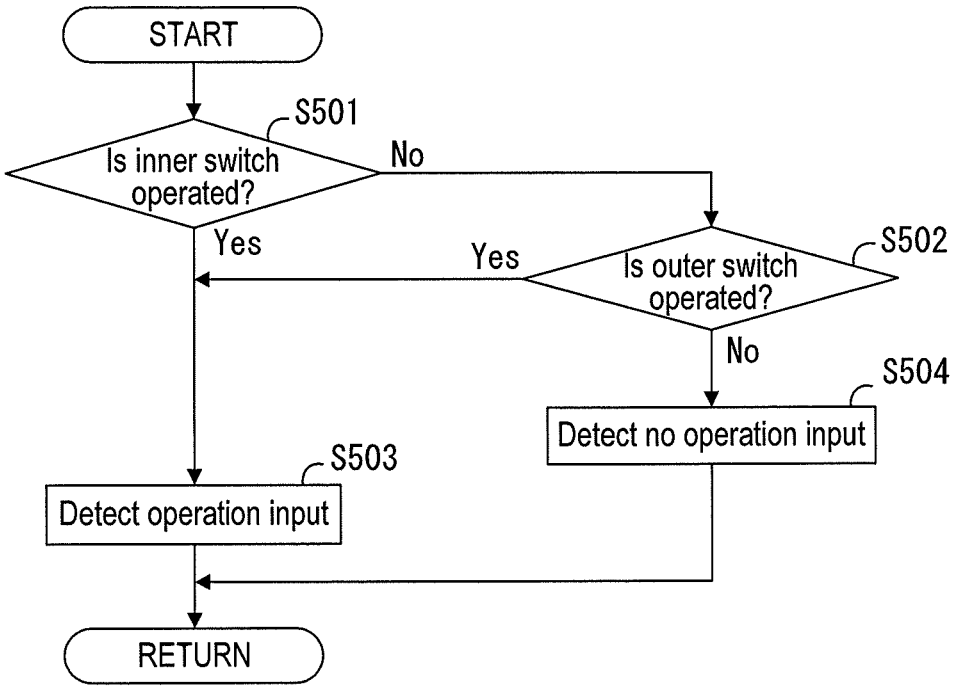
FIG. 8 is a flowchart illustrating an operation procedure of a detection determination of the operation input.

As shown in a flowchart in FIG. 8, in a case where the operation input relative to the inner switch SW1 is detected (Step S501: YES), or in a case where the operation input relative to the outer switch SW2 is detected (Step S502: YES), the control device 60 of the embodiment determines that the operation input relative to the operation switch 40 is detected (Step S503). In a case where the operation input relative to the inner switch SW1 and the outer switch SW2 are not detected (Step S501: NO, Step S502: NO), the control device 60 determines that the operation input relative to the operation switch 40 is not detected (Step S504).

That is, the control device 60 of the embodiment detects the operation input relative to the inner switch SW1 and the outer switch SW2 equally as the operation input relative to the operation switch 40 arranged at the grip portion 50 (51, 52) of the swing door 10.

In other words, according to the door device 41 of the embodiment, the occupant who leaves the vehicle 1 in a state of holding the swing door 10 at the opened angle θ by operating the inner switch SW arranged at the grip portion 51 provided inside the vehicle operates the outer switch SW2 arranged at the outside door handle 52 serving as a grip portion arranged outside the vehicle 1 to release the hold of the swing door 10 which is at the opened angle θ. Similarly, the occupant entering the vehicle 1 while holding the swing door 10 at the opened angle θ by operating the outer switch SW2 operates the inner switch SW1 to release the hold of the swing door 10 which is at the opened angle θ from inside the vehicle 1. Accordingly, according to the door device 41 of the embodiment, the occupant can smoothly open and close the swing door 10 when entering and leaving the vehicle 1.

The control device 60 of the embodiment detects an opening and closing speed ω of the swing door 10 (see FIG. 3). The control device 60 controls the door hold-open device 31 to hold the swing door 10 at the opened angle θ (see FIG. 5, Step S204) to be applied with the braking force F to the swing door 10 larger as the opening and closing speed of the swing door 10 is decreased.

Specifically, the control device 60 of the embodiment compares the detected opening and closing speed ω of the swing door 10 with a predetermined first speed ω1 and a predetermined second speed ω2 (ω1<ω2). Based on the comparison result, the control device 60 changes the braking force F applied to the swing door 10.

Figure 9:
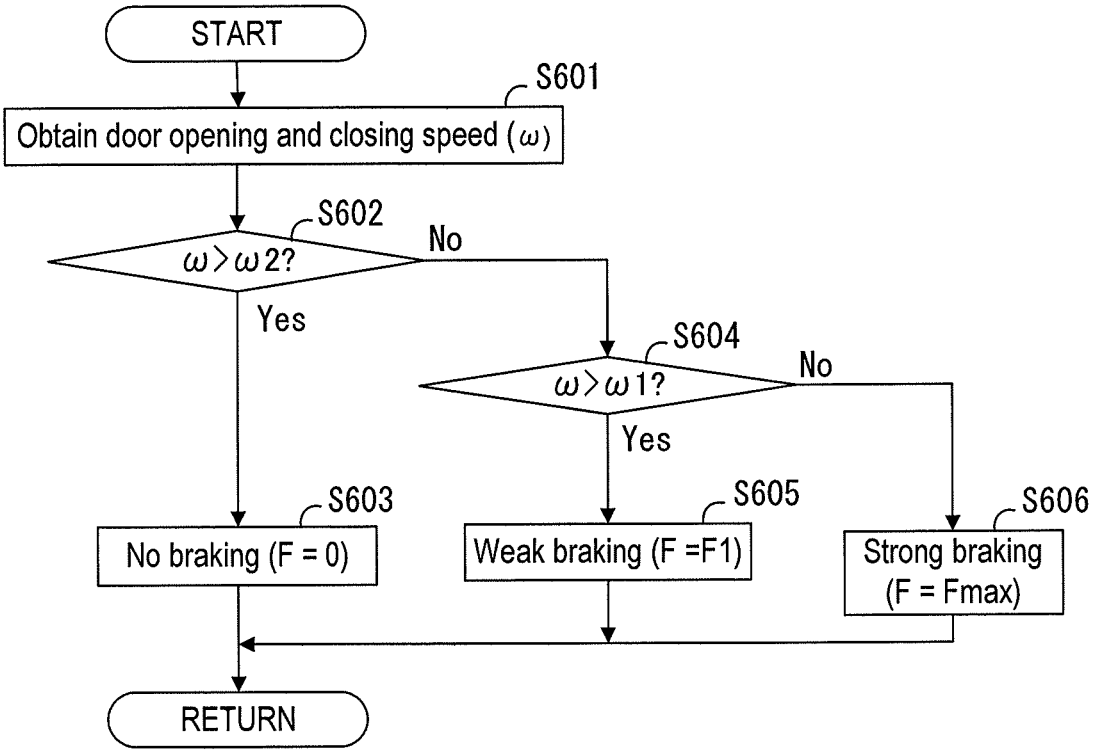
FIG. 9 is a flowchart illustrating an operation procedure of a braking force variable control when the opened angle is held.

In particular, as illustrated in a flowchart in FIG. 9, when obtaining the opening and closing speed ω of the swing door 10 (Step S601), the control device 60 of the embodiment compares the opening and closing speed ω with the predetermined second speed ω2 (Step S602). In a case where the opening and closing speed ω of the swing door 10 is faster than the second speed ω2 (ω>ω2, Step S602: YES), the control device 60 sets the braking force F applied to the swing door 10 to be zero, that is, does not apply the braking force F to the swing door 10 (non-braking state: F=0, Step S603).

In a case where the opening and closing speed ω of the swing door 10 is equal to or lower than the second speed ω2 (ω≤ω2, Step S602: NO), the control device 60 compares the opening and closing speed ω with the predetermined first speed ω1 (Step S604). In a case where the opening and closing speed ω is faster than the first speed ω1 (ω>ω1, Step S604: YES), the control device 60 applies a smaller braking force F1 than a maximum braking force Fmax generated by the door hold-open device 31 to the swing door 10 (small braking force: F=1, Step S605). In a case where the opening speed ω of the swing door 10 is equal to or lower than the first speed ω1 (ω≤ω1, Step S604: NO), the control device 60 of the embodiment controls the door hold-open device 31 to be applied with the maximum braking force Fmax to the swing door 10 (Strong braking force: F=Fmax, Step S606).

Figure 10:
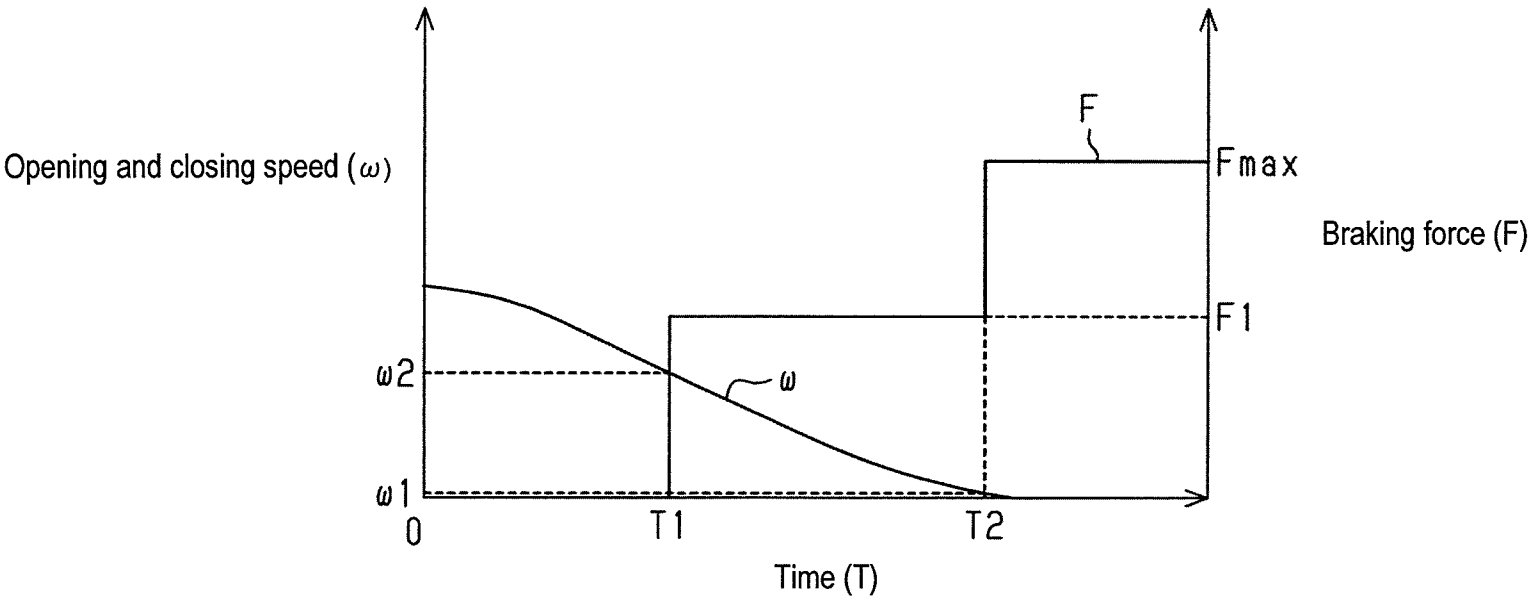
FIG. 10 is an explanatory view illustrating a mode of the braking force variable control.

That is, for example, as illustrated in FIG. 10, in a state where the swing door 10 does not stop completely, the control device 60 inputs the operation request to the operation switch 40, the operation request holding the swing door 10 at the opened angle θ, that is, the door stop request Dst is inputted to the operation switch 40.

In such case, according to the door device 41 of the embodiment, the control device 60 does not apply the braking force F to the swing door 10 until the opening speed ω of the swing door 10 is decreased equal to or lower than the second speed ω2, and a preliminary braking operation or reserved braking operation relative to the swing door 10 is performed (F=F1<Fmax) in a phase when the opening and closing speed ω is equal to or lower than the second speed ω2 (time T1). In addition, an actual braking operation of the swing door 10 is performed (F=Fmax) in a phase when the opening and closing speed ω is decreased equal to or lower than the first speed ω1 (time T2). According to the door device 41 of the embodiment, the swing door 10 is not stopped suddenly at a time point when the swing door 10 opens and closes in a case where the opened angle θ is held so that an excessive load is not applied to a support portion of the swing door 10, for example, the hinges 11 (see FIG. 2A).

Next, the effect and advantage of the embodiment that may be attained will be explained.

The door device 41 includes the latch drive device 21 that unlatches the swing door 10 by the latch mechanism 20, and the door hold-open device 31 that holds the swing door 10 at the opened angle θ. The door device 41 further includes the operation switch 40 including functions as the door open switch 61 issuing the operation request of the latch drive device 21, and as the door stop switch 62 issuing the operation request of the door hold-open device 31. Then, the operation switch 40 is arranged at the grip portion 50 (51, 52) that is employed for opening and closing operation of the swing door 10 so that the operation requests of the latch drive device 21 and the door hold-open device 31 are inputted while the occupant holds the grip portion 50.

According to the aforementioned configuration, the occupant easily performs a series operation of the swing door 10 when entering or leaving the vehicle 1 while holding the grip portion 50 arranged at the swing door 10, the series of operation which are, unlatching the swing door 10 by the latch mechanism 20 (opening the swing door 10), and holding the swing door 10 at the desirable opened angle θ (stopping the swing door 10). Accordingly, the enhanced operability may be achieved.

The door device 41 includes the control device 60 controlling the operations of the latch drive device 21 and the door hold-open device 31 in response to the operation input relative to the operation switch 40. In a case where the operation switch 40 is performed in a state where the swing door 10 is latched in the fully-closed position by the latch mechanism 20 (see FIG. 4), the control device 60 unlatches the swing door 10 by controlling the latch drive device 21. In a case where the operation switch 40 is performed in a state where the swing door 10 is in an openable and closable state, the control device 60 controls the door hold-open device 31 to hold the swing door 10 at the opened angle θ (see FIG. 5, Step S201 to Step S204).

According to the aforementioned configuration, the occupant may unlatch the swing door 10 by the latch mechanism 20 and hold the swing door 10 at the desirable opened angle θ by operating intuitively along the opening operation of the swing door 10 while holding the grip portion 50. Accordingly, the enhanced operation is achieved.

In a case where the operation switch 40 is operated in a state where the door hold-open device 31 holds the swing door 10 at the opened angle θ (see FIG. 6), the control device 60 controls the door hold-open device 31 to release the hold of the swing door 10 which is at the opened angle θ.

According to the aforementioned configuration, the occupant may open and close the swing door 10 again by operating the operation switch 40 arranged at the grip portion 51 even after holding the swing door 10 at the opened angle θ. Accordingly, the occupant holding the grip portion 51 adjusts the opened angle θ of the swing door 10 speedily by the intuitive operation. Accordingly, the enhanced operability is achieved.

In a case where the operation switch 40 receives the operation input continuously beyond the predetermined operation confirmation time t1 (see FIG. 7, Step S403: NO), the control device 60 determines that the operation switch 40 is operated (Step S405).

According to the aforementioned configuration, the swing door 10 is inhibited from causing a phenomenon in which the swing door 10 stops suddenly while being opened or closed, or releases the hold of the swing door 10 which is at the opened angle θ when the occupant enters or leaves the vehicle 1 while using the swing door 10 as a handrail or a grab bar, the phenomenon caused by the misjudgment generated by an unintentional contact with the operation switch 40. Accordingly, enhanced reliability is secured.

In a case where the swing door 10 reaches the previously-memorized auto-stop angle θx (see FIG. 5, Step S205: YES), the control device 60 holds the swing door 10 at the opened angle θ (Step S204) irrespective of whether the operation is inputted relative to the operation switch 40. In a case of detecting the operation input which is continuously performed beyond the predetermined memory requirement time t2 which is longer than the predetermined operation confirmation time t1 (see FIG. 7, Step S406: NO), the control device 60 determines that the operation switch 40 is pressed down or is pressed down for a certain period of time (Step S407). In a case where the swing door 10 is held at the opened angle θ (Step S408: YES), the control device 60 memorizes the opened angle θ as the auto-stop angle θx (Step S410).

According to the aforementioned configuration, the swing door 10 which is in an opened state may be automatically stopped at the opened angle θ where the swing door 10 does not come in contact with the obstacle (for example, a vehicle next to the vehicle, and a wall) existed at sides of the vehicle 1 without the operation of the operation switch 40 by the occupant. Furthermore, the door device 41 may be easily set at the auto-stop angle θx by the intuitive operation, and accordingly, the enhanced operability may be achieved.

The door device 41 includes the inner switch SW1 and the outer switch SW2 as the operation switch 40, the inner switch SW1 arranged at the grip portion 51 inside the vehicle 1, the outer switch SW2 arranged at the outside door handle 52 serving as a grip portion arranged outside the vehicle 1. In a case of detecting the operation input relative to at least one of the inner switch SW1 and the outer switch SW2, the control device 60 determines that the operation input relative to the operation switch 40 (see FIG. 8) is detected.

According to the aforementioned configuration, the occupant who leaves the vehicle 1 in a state of holding the swing door 10 at the opened angle θ by operating the inner switch SW1 arranged at the grip portion 51 provided inside the vehicle 1 operates the outer switch SW2 arranged at the outside door handle 52 serving as a grip portion arranged outside the vehicle 1 to release the hold of the swing door 10 which is at the opened angle θ. The occupant entering the vehicle 1 while holding the swing door 10 at the opened angle θ by operating the outer switch SW2 operates the inner switch SW1 to release the hold of the swing door 10 which is at the opened angle θ from inside the vehicle 1. The occupant releasing the hold of the swing door 10 which is at the opened angle θ by operating the operation switch 40 (SW1, SW2) grips the grip portion 50 (51, 52) arranged at the operation switch 40 to close the swing door 10. Accordingly, the occupant may smoothly open and close the swing door 10 when entering and leaving the vehicle 1, and accordingly, the enhanced operability is secured.

The control device 60 detects the opening and closing speed ω of the swing door 10. In a case of holding the swing door 10 at the opened angle θ, the control device 60 controls the door hold-open device 31 to be applied with the braking force F to the swing door 10 larger as the opening and closing speed ω is decreased.

According to the aforementioned configuration, in a case of holding the swing door 10 at the opened angle θ, the control device 60 inhibits the swing door 10 from stopping suddenly when the swing door 10 is opening and closing. Accordingly, enhanced reliability is secured by the control device 60 that inhibits the support portion of the swing door 10 from being applied with the excessive load, and accordingly, the enhanced quality is secured.

The aforementioned embodiment may be modified as follows. The aforementioned embodiment and modified examples below may be combined, for example, within a scope of the invention technically.

According to the aforementioned embodiment, the operation switch 40 provided at the grip portion 50 (51, 52) of the swing door 10 includes functions as the door open switch 61 issuing the operation request of the latch drive device 21 and as the door stop switch 62 issuing the operation input of the door hold-open device 31. Alternatively, the door open switch 61 and the door stop switch 62 which are separately provided may be provided at the grip portion 50. The door stop switch 62 may either include the function of the releasing switch 63 or be separately provided from the releasing switch 63. The releasing switch 63 may be arranged at positions other than the grip portion 50.

The shape and the position of the grip portion 50 may be freely changed. The plural grip portions 50 may be set at one of the in-vehicle and out-vehicle sides of the swing door 10.

According to the aforementioned embodiment, the operation switch 40 corresponds to the pressing button. Alternatively, for example, a style and an operation input method of a switch may be freely changed, for example, a sliding-style switch.

The memorization of the auto-stop angle θx caused by the continuous operation input (pressing down the switch) of the operation switch 40 may be continuously operated from the operation input relative to the operation switch 40 operated to hold the swing door 10 at the opened angle θ, or may be started from a state where the sliding door 10 is held at the opening angle θ.

According to the aforementioned embodiment, the variable control of the braking force F applied to the swing door 10 in response to the opening and closing speed ω of the swing door 10 is performed by three levels (non-braking force, weak braking force, strong braking force). Alternatively, the variable control may be performed by two levels or plural levels equal to or higher than four levels. The variable control may be continuously performed by using, for example, a map. The mode of the variable control of the braking force F may be changed depending on cases where the control device 60 detects the door stop request Dst (see FIG. 5, Step S203), or where the opened angle θ of the swing door 10 reaches the auto-stop angle θx (Step S205: YES).

According to the aforementioned embodiment, the door device (41) for the vehicle (1) includes the swing door (10) of the vehicle (1), the latch mechanism (20) provided at the swing door (10), the latch drive device (21) configured to unlatch the swing door (10) by driving the latch mechanism (20), the door hold-open device (31) configured to hold the swing door (10) at the opened angle (θ) by applying the braking force (F) to the swing door (10), the door open switch (61) issuing the operation request of the latch drive device (21) to open the swing door (10), the door stop switch (62) issuing the operation request of the door hold-open device (31), and the grip portion (50) employed to open and close the swing door (10), the grip portion (50) including the door open switch (61) and the door stop switch (62) to issue the operation requests of the door open switch (61) and the door stop switch (62) in a state where an occupant of the vehicle (1) holds the grip portion (50).

According to the aforementioned configuration, the occupant easily performs a series operation of the swing door 10 when entering or leaving the vehicle 1 while holding the grip portion 50 arranged at the swing door 10, the series of operation which are, unlatching the swing door 10 by the latch mechanism 20 (opening the swing door 10), and holding the swing door 10 at the desirable opened angle θ (stopping the swing door 10). Accordingly, the enhanced operability may be achieved.

According to the aforementioned embodiment, the door device (41) for the vehicle (1) further includes the operation switch (40) provided at the grip portion (50) to operate as the door open switch (61) and the door stop switch (62), and the control device (60) controlling the latch drive device (21) and the door hold-open device (31) in response to the operation input inputted to the operation switch (40). The control device (60) controls the latch drive device (21) to unlatch the swing door (10) in a case where the operation switch (40) is operated in a state where the swing door (10) is latched at a fully-closed position by the latch mechanism, the control device (60) controlling the door hold-open device (31) to hold the swing door (10) at the opened angle (θ) in a case where the operation switch (40) is operated when the swing door (10) is in an openable and closable state.

According to the aforementioned configuration, the occupant may unlatch the swing door 10 by the latch mechanism 20 and hold the swing door 10 at the desirable opened angle θ by operating intuitively along the opening operation of the swing door 10 while holding the grip portion 50. Accordingly, the enhanced operation is achieved.

According to the aforementioned embodiment, the control device (60) controls the door hold-open device (31) to release the swing door (10) which is held at the opened angle (θ) in a case where the operation switch (40) is operated when the swing door (10) is held at the opened angle (θ).

According to the aforementioned configuration, the occupant may open and close the swing door 10 again by operating the operation switch 40 arranged at the grip portion 51 even after holding the swing door 10 at the opened angle θ. Accordingly, the occupant holding the grip portion 51 adjusts the opened angle θ of the swing door 10 speedily by the intuitive operation. Accordingly, the enhanced operability is achieved.

According to the aforementioned embodiment, the control device (60) determines that the operation switch (40) is operated in a case where the operation input relative to the operation switch (40) is continuously inputted beyond the predetermined operation confirmation time (t1).

According to the aforementioned configuration, in a case of holding the swing door 10 at the opened angle θ, the control device 60 inhibits the swing door 10 from stopping suddenly when the swing door 10 is opening and closing. Accordingly, enhanced reliability is secured by the control device 60 that inhibits the support portion of the swing door 10 from being applied with the excessive load, and accordingly, the enhanced quality is secured.

According to the aforementioned embodiment, in a case where the opened angle (θ) reaches the auto-stop angle (θx) which is previously memorized, the control device (60) controls the door hold-open device (31) to hold the swing door (10) at the opened angle (θ) irrespective of whether the operation input is given; and in a case of detecting the operation input being continuously inputted beyond the predetermined memory requirement time (t2) which is longer than the operation confirmation time (t1), the control device (60) memorizes the opened angle (θ) as the auto-stop angle (θx) in a state where the swing door (10) is held at the opened angle (θ).

According to the aforementioned configuration, the swing door 10 which is in an opened state may be automatically stopped at the opened angle θ where the swing door 10 does not come in contact with the obstacle (for example, a vehicle next to the vehicle, and a wall) existed at sides of the vehicle 1 without the operation of the operation switch 40 by the occupant. Furthermore, the door device 41 may be easily set at the auto-stop angle θx by the intuitive operation, and accordingly, the enhanced operability may be achieved.

According to the aforementioned embodiment, the door device (41) for the vehicle (1) further includes the inner switch (SW1) provided at the grip portion (50) arranged inside the vehicle (1), and the outer switch (SW2) provided at the grip portion (50) arranged outside the vehicle (1). The control device (60) determines that the operation input inputted to the operation switch (40) is detected in a case of detecting the operation input inputted to at least one of the inner switch (SW1) and the outer switch (SW2).

According to the aforementioned configuration, the occupant who leaves the vehicle 1 in a state of holding the swing door 10 at the opened angle θ by operating the inner switch SW1 arranged at the grip portion 51 provided inside the vehicle 1 operates the outer switch SW2 arranged at the outside door handle 52 serving as a grip portion arranged outside the vehicle 1 to release the hold of the swing door 10 which is at the opened angle θ. The occupant entering the vehicle 1 while holding the swing door 10 at the opened angle θ by operating the outer switch SW2 operates the inner switch SW1 to release the hold of the swing door 10 which is at the opened angle θ from inside the vehicle 1. The occupant releasing the hold of the swing door 10 which is at the opened angle θ by operating the operation switch 40 (SW1, SW2) grips the grip portion 50 (51, 52) arranged at the operation switch 40 to close the swing door 10. Accordingly, the occupant may smoothly open and close the swing door 10 when entering and leaving the vehicle 1, and accordingly, the enhanced operability is secured.

According to the aforementioned embodiment, the control device (60) detects the opening and closing speed (ω) of the swing door (10), the control device (60) controlling the door hold-open device (31) to be applied with the braking force (F) increases in response to a decrease of the opening and closing speed (ω) in a case of holding the swing door (10) at the opened angle (θ).

According to the aforementioned configuration, the swing door 10 is not stopped suddenly at a time point when the swing door 10 opens and closes in a case where the opened angle θ is held so that an excessive load is not applied to a support portion of the swing door 10, for example, the hinges 11. Accordingly, enhanced reliability is secured, and the enhanced quality is secured.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door device for a vehicle, comprising:

a swing door of the vehicle;

a latch mechanism provided at the swing door;

a latch drive device configured to unlatch the swing door by driving the latch mechanism;

a door hold-open device configured to hold the swing door at an opened angle by applying a braking force to the swing door;

a door open switch issuing an operation request of the latch drive device to open the swing door;

a door stop switch issuing an operation request of the door hold-open device;

a grip portion employed to open and close the swing door, the grip portion including the door open switch and the door stop switch to issue the operation requests of the door open switch and the door stop switch in a state where an occupant of the vehicle holds the grip portion;

an operation switch provided at the grip portion to operate as the door open switch and the door stop switch; and a control device controlling the latch drive device and the door hold-open device in response to an operation input inputted to the operation switch, wherein the control device determines that the operation switch is operated in a case where the operation input relative to the operation switch is continuously inputted beyond a predetermined operation confirmation time, wherein in a case where the opened angle reaches an auto-stop angle which is previously memorized, the control device controls the door hold-open device to hold the swing door at the opened angle irrespective of whether the operation input is given; and in a case of detecting the operation input being continuously inputted beyond a predetermined memory requirement time which is longer than the operation confirmation time, the control device memorizes the opened angle as the auto-stop angle in a state where the swing door is held at the opened angle.

2. The door device for the vehicle according to claim 1, wherein the control device controls the latch drive device to unlatch the swing door in a case where the operation switch is operated in a state where the swing door is latched at a fully-closed position by the latch mechanism, the control device controlling the door hold-open device to hold the swing door at the opened angle in a case where the operation switch is operated when the swing door is in an openable and closable state.

3. The door device for the vehicle according to claim 2, wherein the control device controls the door hold-open device to release the swing door which is held at the opened angle in a case where the operation switch is operated when the swing door is held at the opened angle.

4. The door device for the vehicle according to claim 2, further comprising:

an inner switch provided at the grip portion arranged inside the vehicle; and an outer switch provided at the grip portion arranged outside the vehicle; wherein the control device determines that the operation input inputted to the operation switch is detected in a case of detecting the operation input inputted to at least one of the inner switch and the outer switch.

5. The door device for the vehicle according to claim 2, wherein the control device detects an opening and closing speed of the swing door, wherein the control device controls a braking force applied to the door hold-open device, and wherein the control device is configured to increase the braking force in response to a decrease of the opening and closing speed in a case of the control device receiving an operation input to hold the swing door at the opened angle.

* * * * *